US011561019B2

(12) United States Patent
Kokugan et al.

(10) Patent No.: US 11,561,019 B2
(45) Date of Patent: Jan. 24, 2023

(54) PERFORMANCE DIAGNOSIS DEVICE AND PERFORMANCE DIAGNOSIS METHOD FOR AIR CONDITIONER

(71) Applicant: Hitachi, Ltd., Tokyo (JP)

(72) Inventors: Yoko Kokugan, Tokyo (JP); Tatsuo Fujii, Tokyo (JP); Akiko Iizuka, Tokyo (JP)

(73) Assignee: HITACHI, LTD., Tokyo (JP)

( * ) Notice: Subject to any disclaimer, the term of this patent is extended or adjusted under 35 U.S.C. 154(b) by 343 days.

(21) Appl. No.: 16/754,151

(22) PCT Filed: Sep. 7, 2018

(86) PCT No.: PCT/JP2018/033175
§ 371 (c)(1),
(2) Date: Apr. 7, 2020

(87) PCT Pub. No.: WO2019/097822
PCT Pub. Date: May 23, 2019

(65) Prior Publication Data

US 2021/0080138 A1 Mar. 18, 2021

(30) Foreign Application Priority Data

Nov. 16, 2017 (JP) ..... JP2017-220648

(51) Int. Cl.
*F24F 11/38* (2018.01)
*F24F 11/64* (2018.01)

(52) U.S. Cl.
CPC ..... *F24F 11/38* (2018.01); *F24F 11/64* (2018.01)

(58) Field of Classification Search
CPC .. F24F 11/38; F24F 11/64; F24F 11/52; F24F 11/49
See application file for complete search history.

(56) References Cited

U.S. PATENT DOCUMENTS

2012/0259583 A1* 10/2012 Noboa ..... H02J 13/00016 702/179
2015/0097626 A1* 4/2015 Kernwein ..... F02P 23/04 331/14
2018/0283722 A1* 10/2018 Jung ..... G05B 15/02

FOREIGN PATENT DOCUMENTS

JP 2010-048433 A 3/2010
JP 2011-012839 A 1/2011
(Continued)

OTHER PUBLICATIONS

International Search Report of PCT/JP2018/033175 dated Oct. 23, 2018.

*Primary Examiner* — Thomas C Lee
*Assistant Examiner* — Charles Cai
(74) *Attorney, Agent, or Firm* — Mattingly & Malur, PC

(57) ABSTRACT

A performance diagnosis device performs data collection of operation data of an air conditioner, and a model database indicates performance corresponding to each operating condition of the air conditioner. The device uses the operation data and the model database to obtain reference data that is a combination of a plurality of operating conditions and a reference value. A performance evaluation unit compares the reference data and evaluation data that is to be evaluated, and evaluates the performance of the air conditioner. A reference data update unit compares the reference data and the evaluation data when the operating conditions match with each other, and updates the reference data. As a result, the deterioration diagnosis technology can update unique reference values that reflect the dimensional errors of each device, differences in installation conditions, and differences in operating conditions to appropriate values with respect to the deterioration of the performance of air conditioners.

9 Claims, 12 Drawing Sheets

(56) References Cited

FOREIGN PATENT DOCUMENTS

| | | | | |
|---|---|---|---|---|
| JP | 2011012839 | A | * | 1/2011 |
| JP | 2015-203544 | A | | 11/2015 |
| JP | 2016-205640 | A | | 12/2016 |

* cited by examiner

FIG. 3

| X AXIS | Y AXIS | Z AXIS |
|---|---|---|
| LOAD RATE (%) | COP | COOLING WATER INLET TEMPERATURE (°C) |
| 20 | 3.1 | 32 |
| | 3.3 | 28 |
| | 3.5 | 24 |
| | 3.9 | 20 |
| | 4.6 | 16 |
| | 5.8 | 12 |
| 40 | 4.9 | 32 |
| | 5.3 | 28 |
| | 5.7 | 24 |
| | 6.3 | 20 |
| | 7.2 | 16 |
| | 8.9 | 12 |
| 60 | 5.7 | 32 |
| | 6.2 | 28 |
| | 6.9 | 24 |
| | 7.6 | 20 |
| | 8.6 | 16 |
| | 10.0 | 12 |
| 80 | 5.9 | 32 |
| | 6.6 | 28 |
| | 7.3 | 24 |
| | 8.1 | 20 |
| | 9.1 | 16 |
| | 10.7 | 12 |
| 100 | 6.3 | 32 |
| | 6.9 | 28 |
| | 7.5 | 24 |
| | 8.3 | 20 |
| | 9.4 | 16 |
| | 11.2 | 12 |

FIG. 7

| CASE | MEASUREMENT SENSOR | | | | | EVALUATION PARAMETER | | |
|---|---|---|---|---|---|---|---|---|
| | 1 | 2 | 3 | 4 | 5 | X | Y | Z |
| 1 | CHILLED WATER INLET TEMPERATURE | CHILLED WATER OUTLET TEMPERATURE | COOLING WATER INLET TEMPERATURE | COOLING WATER OUTLET TEMPERATURE | COOLING WATER/ CHILLED WATER FLOW RATIO | LOAD RATE | COP | COOLING WATER INLET TEMPERATURE |
| 2 | CHILLED WATER INLET TEMPERATURE | CHILLED WATER OUTLET TEMPERATURE | COOLING WATER INLET TEMPERATURE | POWER CONSUMPTION | — | CHILLED WATER TEMPERATURE DIFFERENCE | POWER CONSUMPTION | COOLING WATER INLET TEMPERATURE |
| 3 | CHILLED WATER INLET TEMPERATURE | CHILLED WATER OUTLET TEMPERATURE | AMBIENT AIR TEMPERATURE OF CONDENSER | POWER CONSUMPTION | CHILLED WATER FLOW RATE | LOAD RATE | POWER CONSUMPTION | AMBIENT AIR TEMPERATURE OF CONDENSER |

PERFORMANCE DIAGNOSIS DEVICE AND PERFORMANCE DIAGNOSIS METHOD FOR AIR CONDITIONER

TECHNICAL FIELD

The present invention relates to a performance diagnosis device and a performance diagnosis method for an air conditioner.

BACKGROUND ART

As a device for cooling a relatively large space such as various factories and buildings, a heat-driven chiller or an electric chiller is used. Since the primary energy consumption of the chiller accounts for about 20% to 30% of the entire building, promotion of energy saving has been particularly required in recent years.

Generally, the chiller controls a cooling output according to a required cooling load, and the output changes in a complicated manner, such as high output during the midsummer period of July and August, and low output during the middle period such as May and October.

Further, since it is assumed that a chiller is used for a long period of time, it is important not only to select high-efficiency equipment at the time of installation but also to maintain system performance after aging for energy saving. The above-mentioned chiller has a water circuit that carries cold heat from the chiller to the space to be cooled, and a cooling water circuit that radiates heat to the chiller and heat of the space to be cooled. Scale adheres to pipes over time, and the device itself is deteriorated. In order to maintain a predetermined system performance, it is necessary to eliminate the performance degradation by regular maintenance.

PTL 1 discloses a chiller deterioration diagnosis device and a chiller deterioration diagnosis method for the purpose of accurately separating tube cleaning and overhaul as maintenance contents to be performed for performance deterioration of a chiller. In the technique, an evaluation actual COP and an evaluation actual LTD indicating actual performance under an evaluation operating condition based on evaluation operating situation data are calculated, a COP change amount indicating a difference between the evaluation actual COP and an evaluation reference COP and an LTD change amount indicating a difference between the evaluation actual LTD and an evaluation reference LTD are calculated, and it is determined whether a change amount ratio R between the COP change amount and the LTD change amount at an evaluation time is within a predetermined determination region Q. Here, LTD is an abbreviation of Leaving Temperature Difference, which is one of the indexes indicating the cooling efficiency of a chiller. PTL 1 also describes a reference COP estimation model represented as a band-shaped curved surface in a three-dimensional space.

CITATION LIST

Patent Literature

PTL 1: JP 2016-205640 A

SUMMARY OF INVENTION

Technical Problem

Since the comfort of a building to be cooled or heated (air conditioning) is significantly impaired during midsummer when the cooling load is large, or midwinter when the heating load is large, it is desirable that a period when performance degradation will occur be predicted and maintenance that involves shutting down the air conditioner be performed in spring and autumn when the air conditioning load is less. Of course, when only the cooling operation is performed without performing the heating operation, the cooling operation may be performed during no load such as in the winter.

In addition, a performance diagnostic system that detects an abnormality before it interferes with operation and outputs a signal requesting maintenance takes into account dimensional errors of each device, differences in installation conditions, and differences in operating conditions and operating situations for more accurate diagnosis.

Regarding the creation of a reference COP estimation model used for diagnosing deterioration of a chiller, PTL 1 describes that it is possible to generally use chiller operating situation data obtained before the evaluation time.

However, the reference COP estimation model described in PTL 1 is an estimation model composed of model input data and a reference COP indicating reference performance before deterioration obtained from the chiller, and the reference COP is a COP indicating the performance obtained from a new chiller or a chiller immediately after overhaul. Therefore, if the chiller is not new, a desired operation may not be possible until an event requiring overhaul occurs.

Further, while the chiller (air conditioner) is used for a long period of time, the system configuration itself may be changed from the initial installation due to a change in heat load of the space to be cooled or maintenance. In such a case, the plurality of learned relational expressions do not hold, and there is a possibility that the sign cannot be captured from the change in data.

An object of the invention is to provide a deterioration diagnosis technology that can update unique reference values that reflect the dimensional errors of each device, differences in installation conditions, and differences in operating conditions to appropriate values with respect to the deterioration of the performance of air conditioners.

Solution to Problem

A performance diagnosis device of an air conditioner of the invention includes a data collection unit that collects and records operation data of the air conditioner, and a model database that is a data group indicating performance corresponding to each operating condition of an air conditioner. Further, the performance diagnosis device includes a reference data creation unit that uses the operation data and the model database to obtain reference data that is a combination of a plurality of operating conditions and a reference value, a performance evaluation unit that compares the reference data and evaluation data that is operation data to be evaluated, and evaluates the performance of the air conditioner, and a reference data update unit that compares the reference data and the evaluation data when the operating conditions match with each other, and updates the reference data in a predetermined case.

Advantageous Effects of Invention

According to this invention, it is possible to provide a deterioration diagnosis technology that can update unique reference values that reflect the dimensional errors of each device, differences in installation conditions, and differences in operating conditions to appropriate values with respect to the deterioration of the performance of air conditioners.

BRIEF DESCRIPTION OF DRAWINGS

FIG. 3 is a table illustrating an example of a model database according to the embodiment.

FIG. 7 is a table illustrating an example of a configuration of an evaluation parameter according to the first embodiment.

DESCRIPTION OF EMBODIMENTS

A performance diagnosis device and a performance diagnosis method for an air conditioner of the invention are suitable as a technology for monitoring an air conditioner from a remote place.

In the following description, a cooling operation of a chiller is mainly described. However, in the case of a heat pump capable of performing not only the cooling operation but also the heating operation, it is necessary to consider an air conditioning load including a cooling load and a heating load. This specification discloses a technique applicable to a case where only the cooling operation is performed and a case where both the cooling operation and the heating operation are performed. Chillers, heat pumps, and the like are collectively referred to as "air conditioners". An air conditioning load rate described later means a load rate of the air conditioner that performs at least one of the cooling operation and the heating operation.

The air conditioner may be any of an electric type and a heat driven type.

An electric air conditioner includes an electric compressor. On the other hand, examples of the heat-driven air conditioner include an absorption chiller, an absorption heat pump, an adsorption chiller, and an adsorption heat pump. The heat source of the heat-driven air conditioner is combustion heat of gas, petroleum, etc., and factory exhaust heat.

Hereinafter, a performance diagnosis device and a performance diagnosis method of an air conditioner (chiller) according to an embodiment of the invention will be described in detail with reference to the drawings.

First Embodiment

Figure 1:
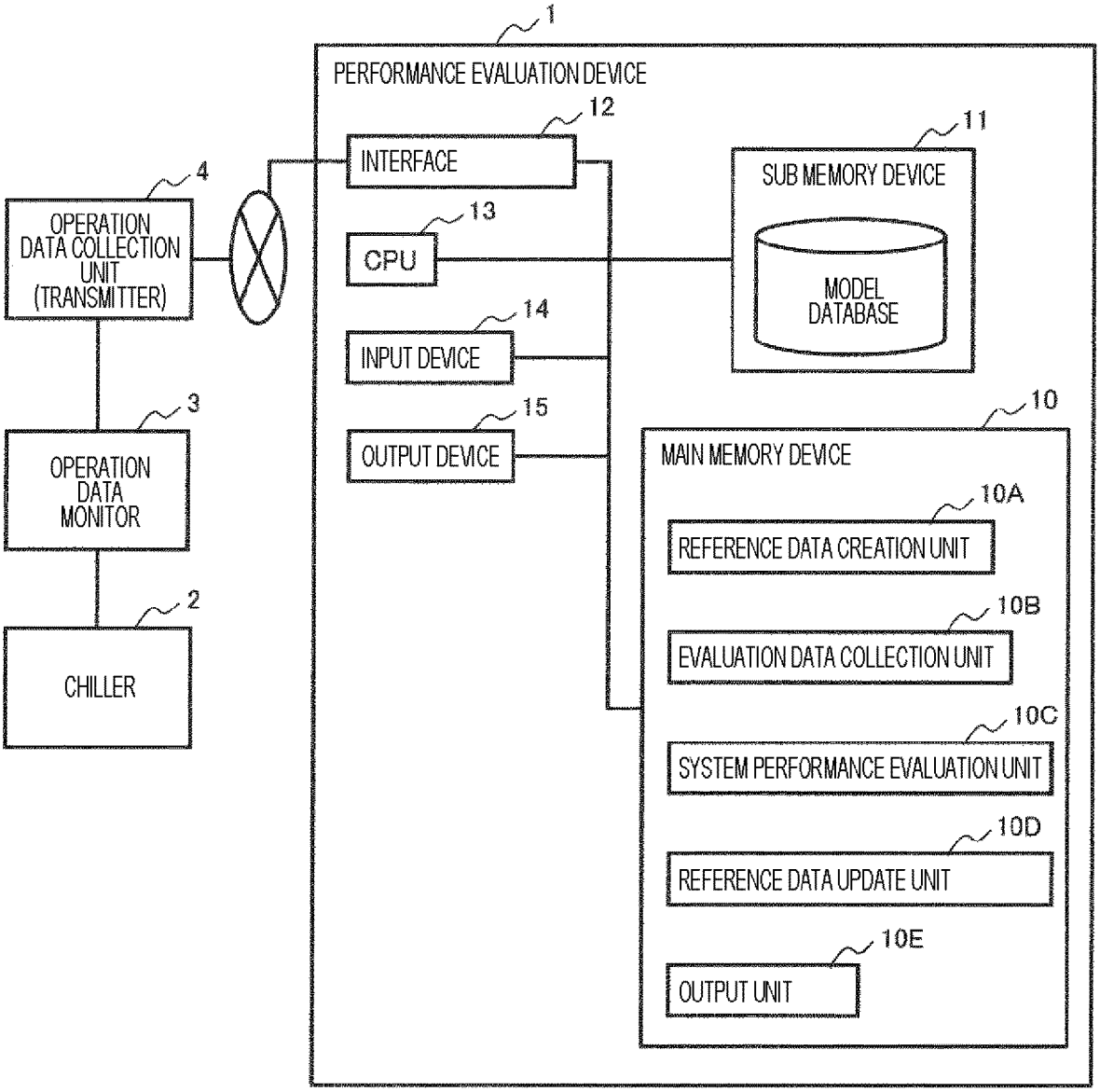
FIG. 1 is a block diagram illustrating a configuration of a performance evaluation device according to an embodiment.

FIG. 1 is a block diagram illustrating a configuration of the performance diagnosis device of this embodiment.

Figure 2:
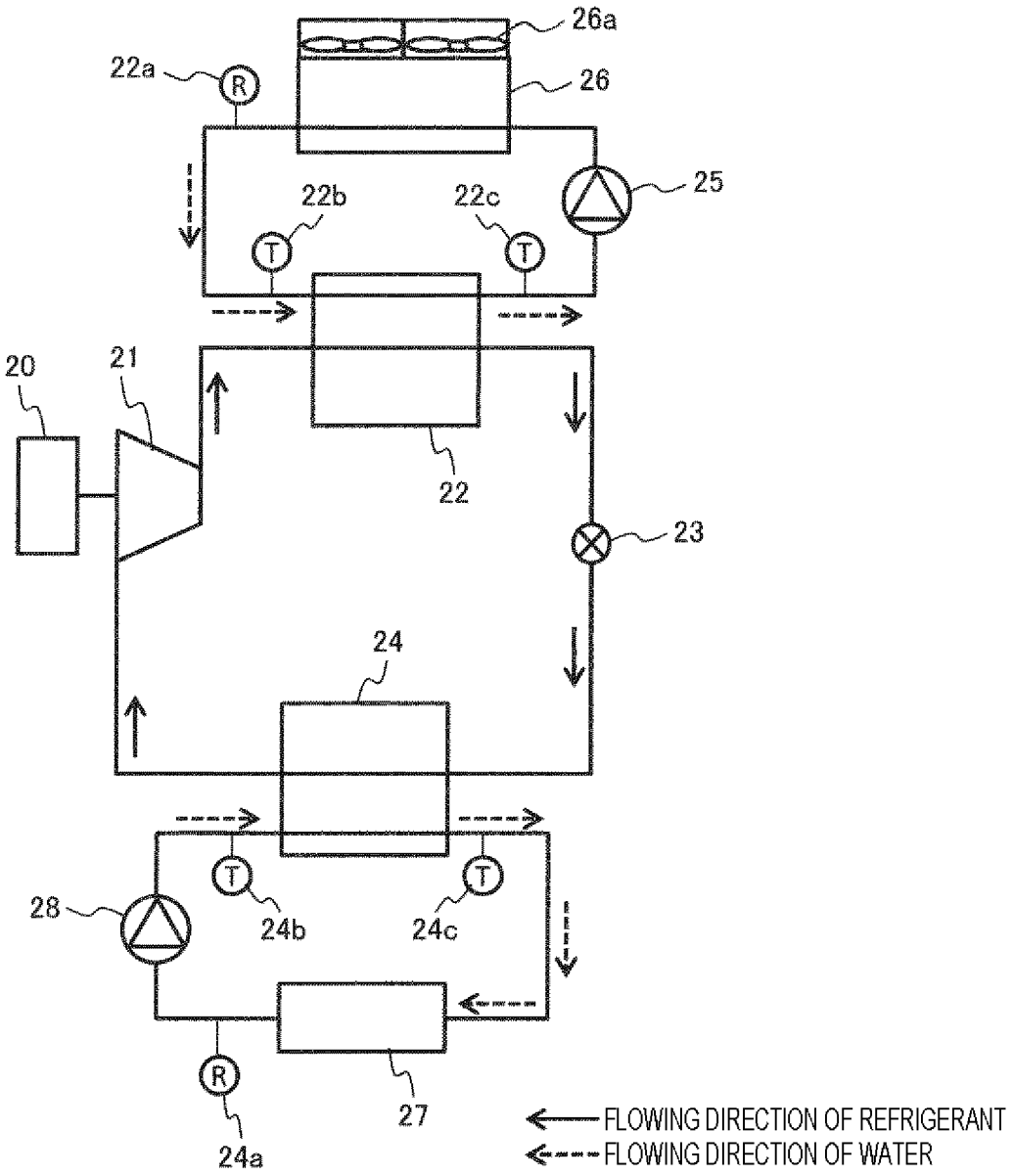
FIG. 2 is a schematic configuration diagram illustrating a structure of a chiller of the embodiment and an arrangement of measurement sensors.

FIG. 2 illustrates an example of the configuration of a chiller which is a performance evaluation target.

First, the configuration of the performance diagnosis device of FIG. 1 will be described.

A performance evaluation device 1 of a chiller 2 (hereinafter also referred to as "performance diagnosis device") is connected to the chiller 2 via an operation data monitor 3 (display unit) and an operation data collection unit 4 that is a transmitter. The operation data acquired by the operation data collection unit 4 includes a signal from a sensor provided in the chiller 2, and includes raw data obtained from the chiller 2 that is actually operating. The operation data collection unit 4 has a function of measuring data corresponding to a desired evaluation parameter via a sensor provided in the chiller 2, and a function of recording the measured time-series data as history data. In this embodiment, the configuration in which the operation data transmission unit is provided outside the performance evaluation device 1 will be described, but the operation data transmission unit may be provided inside the performance evaluation device 1.

In this embodiment, a turbo chiller is assumed as the chiller 2, and details of its configuration will be described later with reference to FIG. 2.

The performance evaluation device 1 includes a main memory device 10 (first memory unit), a sub memory device 11 (second memory unit), an interface 12, a CPU 13 (central processing unit), an input device 14 (input unit), and an output device 15 (output unit) to diagnose a change in performance of the chiller 2. The main memory device 10 includes a reference data creation unit 10A, an evaluation data collection unit 10B, a system performance evaluation unit 10C (performance evaluation unit), a reference data update unit 10D, and an output unit 10E. The first memory unit and the second memory unit can be simply referred to as a "memory unit".

The sub memory device 11 stores a model database.

FIG. 2 is a configuration diagram illustrating an example of the structure of a chiller and an arrangement of measurement sensors when a performance evaluation device is applied. This drawing illustrates a case where the chiller is a turbo chiller.

The turbo chiller mainly forms a refrigerant circuit by sequentially connecting a turbo compressor 21 which obtains power from an electric motor 20, a condenser 22, an expansion mechanism 23, and an evaporator 24 using a refrigerant pipe.

As measurement sensors, a chilled water inlet temperature sensor 24*b*, a chilled water outlet temperature sensor 24*c*, a cooling water inlet temperature sensor 22*b*, a cooling water outlet temperature sensor 22*c*, a chilled water flow meter 24*a*, and a cooling water flow meter 22*a* are provided at various locations.

In the evaporator 24, chilled water is generated such that the temperature measured by the chilled water outlet temperature sensor 24*c* becomes a predetermined value. The chilled water is sent to a cooled space 27 (such as a room in a building) by the power of a water circulation pump 28, and absorbs heat from the cooled space 27. The chilled water whose temperature has increased due to heat absorption exchanges heat with the refrigerant in the evaporator 24 and is cooled. Then, the refrigerant in the evaporator 24 is carried to the condenser 22 through the refrigerant pipe, and radiates heat to the cooling water. The cooling water is sent to a cooling tower 26 by a water circulation pump 25. In the cooling tower 26, a cooling tower fan 26*a* is controlled so that the temperature measured by the cooling water inlet temperature sensor 22*b* becomes a predetermined value, and the heat of the cooling water is radiated to the atmosphere.

The device configuration and operation of the chiller illustrated in FIG. 2 are merely examples, and do not limit the operation principle, arrangement, and the like of the chiller to be evaluated by the chiller performance evaluation device 1 of this embodiment.

The reference data creation unit 10A of FIG. 1 has a function of creating data of the system performance in a state where no deterioration has occurred in the chiller over the entire expected operating range using the model database stored in the sub memory device 11 and a part of the data stored in the operation data collection unit 4.

FIG. 3 illustrates an example of data included in the model database.

The model database of this embodiment is a data group covering operating conditions that satisfy the specifications of the chiller. The model database is a data group indicating the performance corresponding to each operating condition of the air conditioner, and may be compiled from the results of the performed quality confirmation test measured using a testing machine before shipment to be included in the design values of chillers and catalogs issued by chiller manufacturers. A COP (Coefficient of Performance) equivalent to the system performance of the chiller changes depending on the air conditioning load rater, cooling water inlet temperature, and chilled water outlet temperature. However, in this drawing, the chilled water outlet temperature is fixed, and the air conditioning load rate (hereinafter, also simply referred to as "load rate"), the COP, and the cooling water inlet temperature are used as evaluation parameters and are arranged in three axes of an X axis, a Y axis, and a Z axis.

As illustrated in this drawing, when the load rates are equal, the COP is higher under the condition where the cooling water inlet temperature is low (spring, autumn, and winter). On the other hand, the COP is low under conditions where the cooling water inlet temperature is high (summer).

The evaluation target of this embodiment is a water-cooled chiller, but in an air-cooled chiller that does not require cooling water, the ambient air temperature of the condenser may be used as an evaluation parameter instead of the cooling water inlet temperature.

Here, the air conditioning load rate is a value obtained by dividing the amount of heat to be processed in the indoor unit by the rated capacity of the air conditioning. When cooling water is cooled by an evaporator in the cooling operation and supplied to the indoor unit, the air conditioning load rate is a value obtained by dividing the difference between the chilled water outlet temperature and the chilled water inlet temperature of the actually operating chiller by the difference between the chilled water outlet temperature and the chilled water inlet temperature which are set as design values of the chiller. Specifically, in FIG. 2, the inlet and outlet temperatures of the chilled water cooled by the evaporator 24 are calculated using the values measured by the chilled water inlet temperature sensor 24*b* and the chilled water outlet temperature sensor 24*c*, respectively.

Generally, in the case of a compression chiller (heat pump), it is possible to perform a heating operation using heat generated in a condenser. In this case, when the hot water is heated by the condenser and supplied to the indoor unit, the air conditioning load rate is a value obtained by dividing the difference between a hot water outlet temperature and a hot water inlet temperature of the actually operating heat pump by the difference between the hot water inlet temperature and the hot water outlet temperature which are set as the design values of the heat pump. When the heating operation by the compression chiller (heat pump) is performed using air as a heat medium circulating between the indoor unit and the condenser, the temperatures of the air on the upstream and downstream sides of the condenser are measured. Then, the air conditioning load rate is calculated as the inlet temperature and the outlet temperature by the same calculation as in the case of hot water.

In the case of the heating operation in the absorption heat pump, the hot water is heated by heat generated in at least one of the condenser and an absorber, and the hot water is sent to the indoor unit to perform heating. Therefore, the air conditioning load rate is a value obtained by dividing an average value of the difference between the hot water outlet temperature and the hot water inlet temperature of the absorption heat pump actually operating, for the hot water returned from the indoor unit, by the difference between the hot water outlet temperature and the hot water inlet temperature that are set as the design values of the absorption heat pump.

By the way, the system performance of an actual chiller generally does not match the model database due to the influence of the installation status and the like, even in a state where the system performance in the initial stage of installation does not deteriorate. In this embodiment, in order to accurately grasp the system performance in a state where there is no deterioration for each device, a part of the data stored in the operation data collection unit 4 is used to correct the model database so as to create unique reference data (combination data group of operating conditions and reference values; hereinafter, also referred to as "individual characteristic surface") of the chiller 2.

Figure 4:
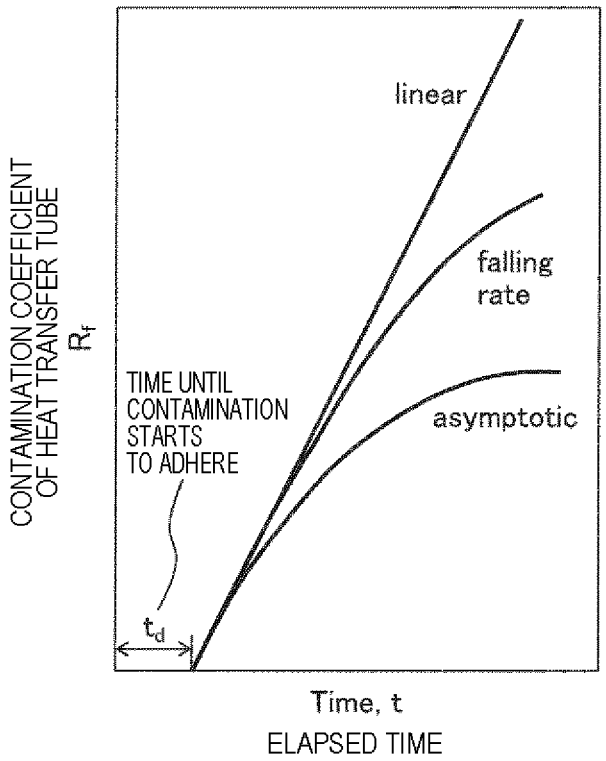
FIG. 4 is a graph illustrating a time-series change of general heat transfer tube contamination.

FIG. 4 is a graph illustrating a time-series change of general heat transfer tube contamination.

Most of the causes of deterioration of the system performance of the chiller arise due to the adhesion of scale or the like to the inside of the heat transfer tube for cooling water or chilled water. In the heat transfer tube, minerals and the like in the water crystallize due to heating and evaporation of the circulating water, and these are deposited to form scale.

From FIG. 4, it can be seen that although the adhesion speed of the dirt (scale) differs depending on the flow rate and temperature of the circulating water, there is a certain period of time td during which the dirt does not adhere inside the heat transfer tube. This period varies depending on the configuration of the equipment, installation environment, and operating conditions, but with the chiller as illustrated in this embodiment, there is a tendency that there is almost no deterioration in system performance due to scale adhesion for one year after installation. Further, from this drawing, it can be seen that the contamination coefficient rapidly increases when the contamination starts to adhere.

Therefore, the reference data creation unit 10A illustrated in FIG. 1 uses, for example, data of the first one year (hereinafter referred to as "normal data") among the operation data stored in the operation data collection unit 4 to correct the model data and create data of the system performance in a state where the chiller 2 is not deteriorated in the entire expected operating range as an individual characteristic surface. The normal data does not necessarily have to be data for one year, and any data shorter or longer than this may be sufficient as long as sufficient data can be collected for creating reference data.

Therefore, the system performance evaluation unit 10C compares the operation data measured after acquiring the normal data (operation data at a time different from the normal data) with the individual characteristic surface to evaluate the performance of the air conditioner. Further, the operation data to be compared may include the normal data.

As described above, the corrected reference data is obtained based on the actual operation data acquired for each model, so that a slight performance deterioration of the chiller 2 can be detected.

Figure 5:
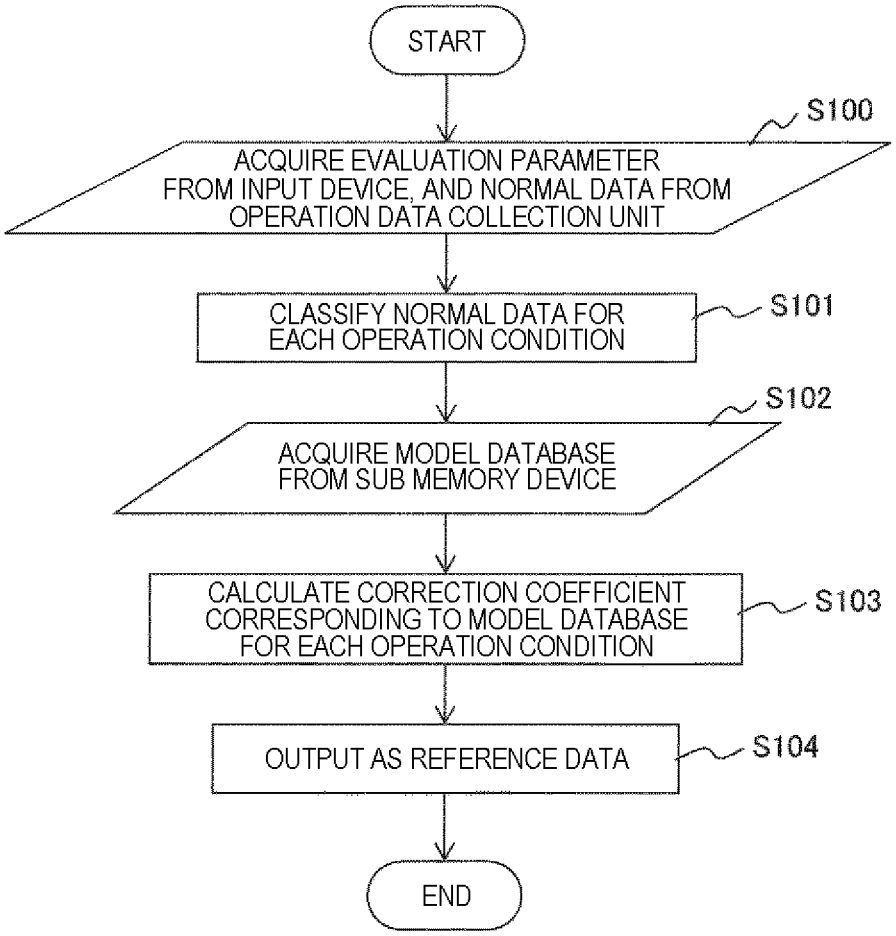
FIG. 5 is a flowchart illustrating processing steps in a reference data creation unit according to a first embodiment.

FIG. 5 is a flowchart illustrating data processing in the reference data creation unit 10A of FIG. 1.

Hereinafter, a method for creating the individual characteristic surface in the above-described reference data creation unit 10A will be described with reference to FIG. 5. In the following description, reference numerals used in FIGS. 1 and 2 are also added.

First, in S100, the evaluation parameter input from the input device 14 is obtained, and the normal data is obtained from the operation data collection unit 4. In this embodiment, the evaluation parameters are the load rate, the COP, and the cooling water inlet temperature.

Here, the load rate is a ratio of the difference between the chilled water inlet temperature sensor 24*b* and the chilled water outlet temperature sensor 24*c* in the actual operation data to the difference between the chilled water inlet temperature and the chilled water outlet temperature that is the maximum in the model data. The COP is a value obtained by dividing the value obtained by multiplying the difference between the temperatures, obtained by the chilled water outlet temperature sensor 24*c* and the chilled water inlet temperature sensor 24*b*, by the measurement value of the chilled water flow meter 24*a*, by the power consumed by the electric motor 20 which is the power source of the turbo compressor 21. The cooling water inlet temperature is a value measured by the cooling water inlet temperature sensor 22*b*.

Next, in S101, in order to evaluate the system performance, the normal data is classified for each operating condition, with a load rate other than the COP and the cooling water inlet temperature corresponding to the system performance of the chiller 2 in the evaluation parameters as operating conditions.

Subsequently, in S102, a model database is obtained from the sub memory device 11. Then, in S103, a correction coefficient for matching the normal data and the model data is calculated for each operating condition. Although there is no normal data depending on the operating condition of the chiller 2, interpolation or extrapolation of the correction coefficient of a portion where the operating condition matches is performed, and the correction coefficient is calculated in the entire operating range in the model database. By calculating the correction coefficient in this manner, even when the normal data obtained from the chillers (actually installed chillers) installed in different conditions is less, the correction coefficient in the entire operating range corresponding to the normal data can be calculated.

Finally, in S104, each piece of data in the model database is multiplied by a corresponding correction coefficient for each operating condition to create an individual characteristic surface which is a system performance without deterioration of the chiller 2 actually installed. This data is not only a data group similar to the model database, but also the load rate of the evaluation parameter, the COP, and the cooling water inlet temperature are output from the output unit 10E of the main memory device 10 as a three-dimensional graph with three axes of X axis, Y axis, and Z axis, and displayed in the operation data monitor 3 through the output device 15.

Figure 6:
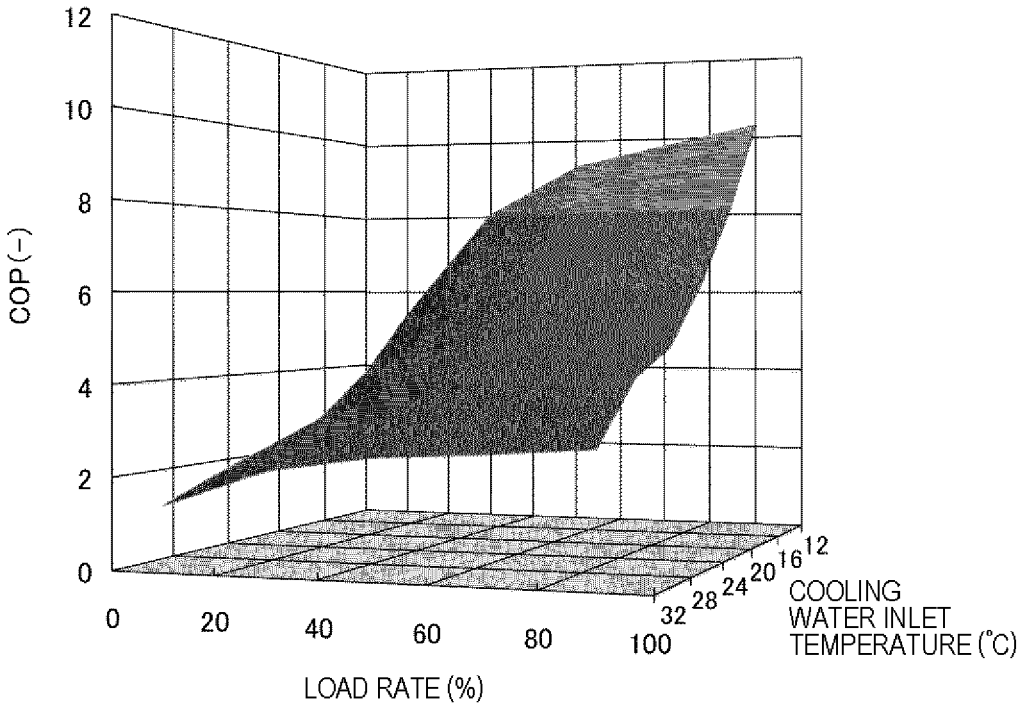
FIG. 6 is a three-dimensional graph illustrating an example of an individual characteristic surface of the first embodiment.

FIG. 6 illustrates an example of the individual characteristic surface displayed on the operation data monitor 3.

As illustrated in this drawing, when the cooling water inlet temperature is low and the load rate is high, the COP is high. On the other hand, when the cooling water inlet temperature is high and the load rate is low, the COP is low.

The evaluation parameters may be configured by items corresponding to the performance and operating conditions of the chiller, and can be appropriately changed by a measurement sensor installed in the chiller to be evaluated.

As described above, the individual characteristic surface obtained from the model database and the normal data of the chiller different from the test chiller installed in the building to be actually air-conditioned can be used as correct approximate data of a chiller as a reference in the entire operating range. The individual characteristic surface is reference data in the entire operating range in consideration of the installation state including the arrangement of the piping of the chiller, the inclination of the apparatus, and the like, and the installation state of measurement sensors and the like slightly different for each apparatus. Further, the model database is complete with data groups in all areas of the required load rate and evaluation parameters calculated from the data groups. These data groups also include data under operating conditions with a low load rate, and may be design values of chillers and data accurately measured before shipment using a test chiller (test machine).

FIG. 7 illustrates an example of the configuration of the evaluation parameters for the installed measurement sensors.

Case 1 corresponds to FIG. 6. On the other hand, Cases 2 and 3 are modifications.

The evaluation parameters X and Z illustrated in FIG. 7 correspond to the X axis and the Z axis in FIG. 6, and are external factors that affect the performance of the air conditioner (chiller). On the other hand, the evaluation parameter Y illustrated in FIG. 7 corresponds to the Y axis in FIG. 6, and is a parameter serving as an index for performance evaluation. In other words, the evaluation parameter Y is arranged in relation to the evaluation parameters X and Z. In this way, the evaluation parameters X, Y and Z are put together as a data group.

Further, the number of evaluation parameters serving as external factors affecting the performance of the air conditioner may be three or more.

In summary, the individual characteristic surface includes two or more evaluation parameters (operating conditions) that are external factors affecting the performance of the air conditioner, and the two or more evaluation parameters are arranged in relation to another evaluation parameter (an index of performance evaluation).

In the case of an absorption chiller, as an evaluation parameter that is an external factor affecting the performance of the air conditioner, the cooling water for removing heat generated in at least one of the absorber and the condenser or the inlet temperature of the cooling air may be used. The evaluation parameter serving as an index for performance evaluation may be the amount of heat input to a regenerator.

Further, the evaluation parameter serving as an external factor affecting the performance of the air conditioner may be a function related to the air conditioning load rate.

Further, an LTD may be used as an evaluation parameter. In this case, the LTD is treated as Y.

Next, a method for evaluating system performance according to this embodiment will be described.

Figure 8:
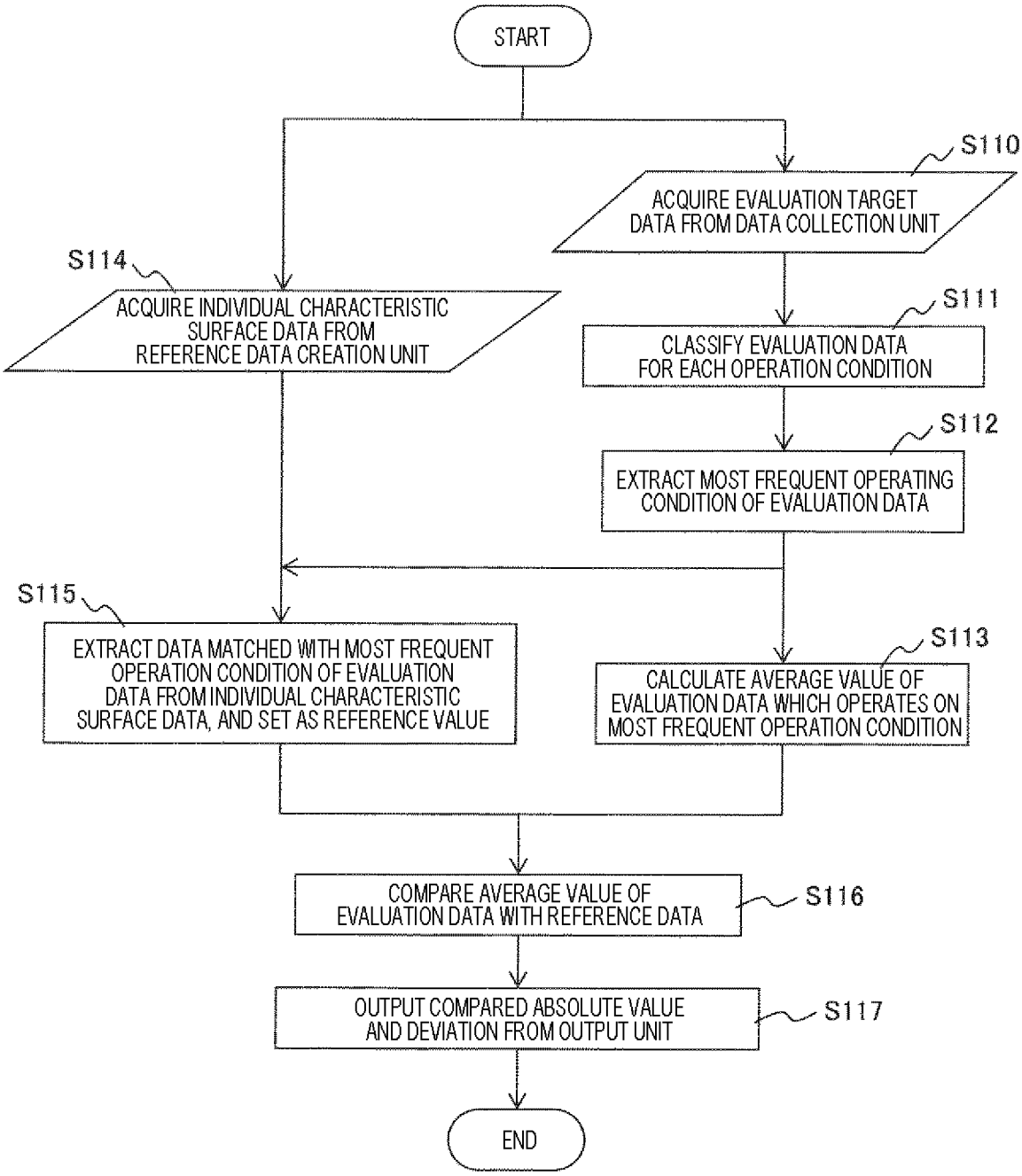
FIG. 8 is a flowchart illustrating processing steps in a system performance evaluation unit according to the first embodiment.

FIG. 8 is a flowchart illustrating processing steps in the system performance evaluation unit 10C of this embodiment.

First, in S110, evaluation target data is acquired from the operation data collection unit 4. The evaluation target data is operation data of the chiller 2 (FIG. 1) during a designated period. As a method for specifying a period, an arbitrary evaluation period may be input from the input device 14 in FIG. 1, or a setting may be made such that the evaluation is automatically performed at regular intervals. In other words, the evaluation target data is a part of the operation data included in the operation data collection unit 4. The evaluation target data is operation data of the evaluation target, and is also referred to as "evaluation data".

Next, in S111, the evaluation target data is classified for each operating condition. This operating condition is made to match the evaluation parameter of the operating condition of the individual characteristic surface, and in this embodiment, is the cooling water inlet temperature. After that, in S112, the operating condition with the highest appearance frequency (the most frequent operating condition) in the classified evaluation target data is extracted. Here, the most frequent operating condition is the load rate with the highest appearance frequency in this embodiment. In addition, when the operating condition for classifying the evaluation target data in S111 is a load rate, the most frequent operating condition is the cooling water inlet temperature with the highest appearance frequency.

Further, in S113, the COP is calculated from the evaluation target data in the load rate with a high appearance frequency extracted for each cooling water inlet temperature condition, and is used as representative evaluation data. Then, an average value of the evaluation target data is calculated. As the representative evaluation data, the power consumption used in Cases 2 and 3 of FIG. 7 may be used instead of the COP. When the COP has decreased, it is determined that the performance has deteriorated, and when the COP has increased, it is determined that the performance has improved. On the other hand, when the power consumption has increased, it is determined that the performance has deteriorated, and when the power consumption has decreased, it is determined that the performance has improved. Therefore, the representative evaluation data is an average value of a parameter serving as an index of performance evaluation in the region.

On the other hand, in S114, the individual characteristic surface created by the reference data creation unit 10A is acquired.

Then, in S115, data that matches the operating condition of the representative evaluation data is extracted from the individual characteristic surface, and is set as a reference value. Therefore, the reference value is a value of the individual characteristic surface (the value of the Y axis (COP) in FIG. 6) under the operating condition corresponding to the value of the representative evaluation data.

In S116, the representative evaluation data of S113 (representative evaluation data of the evaluation data) is compared with the reference value of S115 (the reference value of the reference data). Specifically, the deviation of the evaluation target data from the normal data is calculated. The result and the unique reference data are accumulated in the system performance evaluation unit 10C each time the evaluation is performed, and the degree of deterioration is evaluated from the change in the system performance with respect to the elapsed time. In other words, the system performance evaluation unit 10C has a function of accumulating the unique reference data and the result obtained by comparing the operation data collected at a plurality of different times with the unique reference data, and determines a change in performance of the air conditioner using these values.

Finally, in S117, the data is output from the output unit 10E of the main memory device 10 and displayed on the operation data monitor 3 via the output device 15.

Next, a method for updating the reference data update unit according to this embodiment will be described. The reference data update unit 10D of FIG. 1 has a function of updating a reference value in a predetermined case as necessary based on the performance of the evaluation target data acquired from the operation data collection unit 4.

Figure 9:
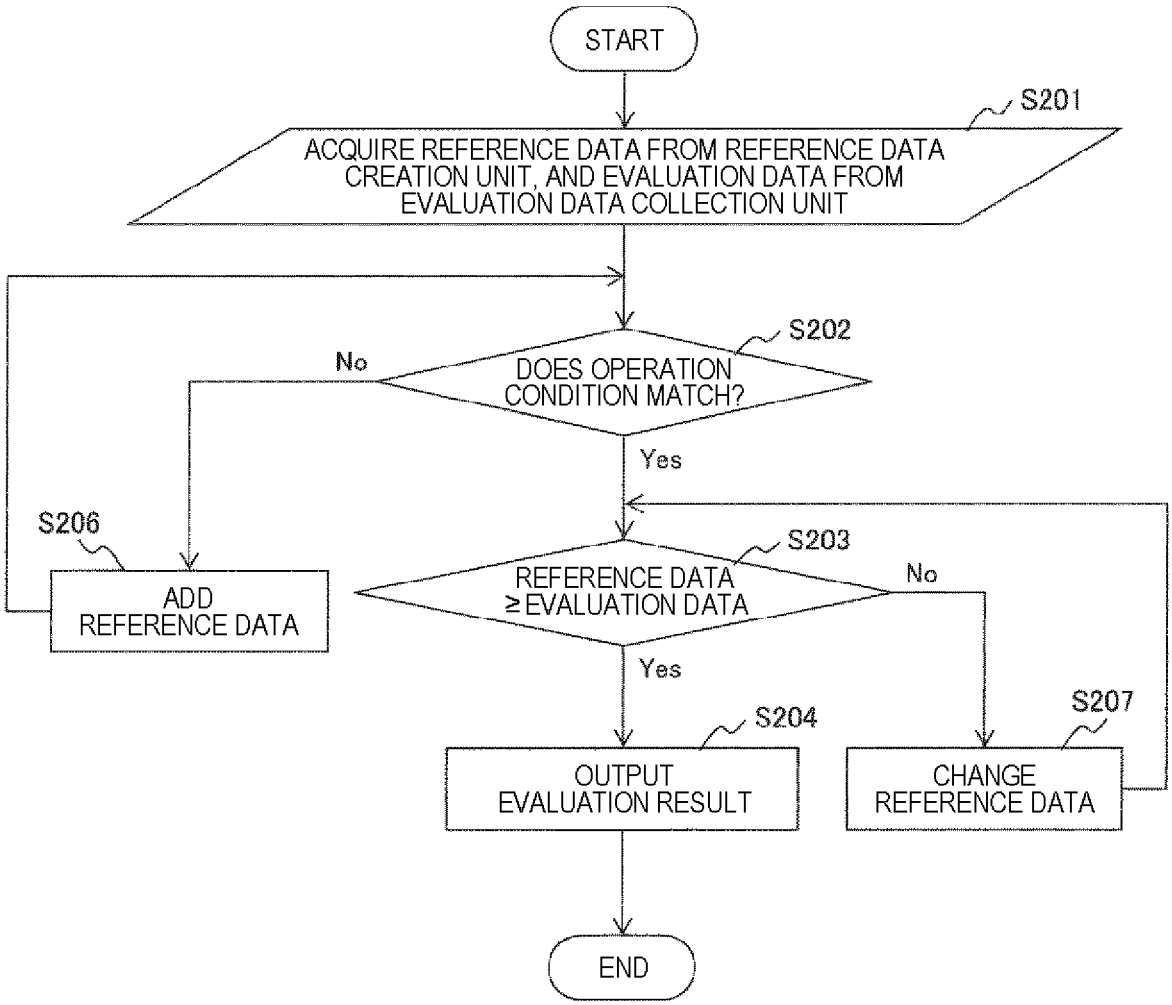
FIG. 9 is a flowchart illustrating processing steps in a reference data update unit according to the first embodiment.

FIG. 9 is a flowchart illustrating a processing step for determining whether updating is necessary in the reference data update unit 10D.

First, in S201, an individual characteristic surface is acquired from the reference data creation unit 10A, and evaluation data that is a part of the operation data of the operation data collection unit 4 is collected from the evaluation data collection unit 10B.

Thereafter, in S202, the acquired evaluation data is compared with the operating condition of the individual characteristic surface. Since the individual characteristic surface, which is the reference data of this embodiment, is a data group of the system performance in a state where there is no deterioration in the entire expected operating range of the chiller 2, the reference data in this embodiment has the operating condition of the evaluation data. Therefore, in S202, it is determined that the operating conditions match, and the process proceeds to step S203. The case where the operating conditions do not match in S202 will be described later in a second embodiment.

In S203, the performance of the reference data and the performance of the evaluation data under the same operating conditions are compared. Here, the performance can be compared with the COP (which may be a predicted value of the COP). If the performance of the reference data is superior to or equal to the performance of the evaluation data, the process proceeds to S204, and a deviation of the evaluation target data from the reference data is calculated as an evaluation result. On the other hand, if the performance of the reference data is inferior to the performance of the evaluation data, the reference data is updated based on the value of the evaluation data (S207). That is, as illustrated in the data processing (FIG. 5) in the reference data creation unit 10A in FIG. 1, the model data is corrected using the evaluation data as normal data, and an individual characteristic surface is created as new reference data.

The updated new reference data is used again in S203 for performance comparison. However, since the same data is compared here, the process proceeds to S204, and the deviation of the evaluation target data from the reference data is calculated as an evaluation result. This result is accumulated in the system performance evaluation unit 10C every time the evaluation is performed, and the degree of deterioration is evaluated from the change in the system performance with respect to the elapsed time. Further, the system performance evaluation unit 10C accumulates not only the deviation but also an update history (update time and value) of the reference data.

These results are output from the output unit 10E of the main memory device 10 and displayed on the operation data monitor 3 via the output device 15.

FIG. 9 is a flowchart for determining whether to update the reference data in S202 for convenience of explaining the function of the reference data update unit 10D. However, S201 to S203 are processes corresponding to the processes S110 to S116 in the system performance evaluation unit 10C, and may practically be considered as part of the processes of the system performance evaluation unit 10C.

The above deviation is calculated from a narrow range of evaluation target data within a specified period, but since the correction coefficient corresponding to the normal data is obtained for the entire region of the unique reference data, it is possible to perform a trial calculation on how much the annual power consumption increases and how much the running cost increases when the chiller is continuously operated without performing the maintenance. This can provide the user with persuasive data on the need for maintenance.

Specifically, using the operation data acquired in spring, fall, winter, and the like when the air conditioning load rate is low, the evaluation parameters in a range of all the operating conditions including the operating condition with the high air conditioning load rate can be estimated by the correction coefficient. Therefore, the current degree of performance degradation can be determined in consideration of annual power consumption, running costs, and the like.

More specifically, based on the maximum value of the air conditioning load rate at the time when the air conditioning load rate becomes high (in the case of a chiller, generally in the summer season), the air conditioning load rate is a ratio to the maximum value. For example, a rate collected during a period (in the case of a chiller, spring, fall, winter, etc.) when the rate is 50% or less is used to calculate an estimated value of the operation data in the region where the ratio exceeds 50%, and the estimated value and the individual characteristic surface data may be compared. The estimated power may be used to calculate annual power consumption, running cost, and the like. The current degree of performance degradation can be determined in consideration of annual power consumption, running costs, and the like. The above determination may be made using data collected at a time when the above ratio is 30% or less.

In addition, the performance evaluation device 1 of this embodiment has a function of updating the reference value even in a case where, for example, an introduction timing of the performance evaluation device 1 is delayed with respect to the start of operation of the chiller, and the data collection unit cannot obtain operation data immediately after the operation of the chiller to be evaluated, that is, a case where there is a possibility that deterioration is included in the normal data. Therefore, the reference data finally created by the reference data creation unit can be set to an ideal value having no deterioration while reflecting a dimensional error of each device, a difference in an installation state, and a difference in an operating condition and an operating situation. As a result, a highly accurate deterioration diagnosis technique can be provided.

Furthermore, when the reference data is updated, the reference data before the update and the new reference data are written together and displayed on the operation data monitor 3 via the output device 15, thereby improving the performance after the maintenance, and easily confirming the frequency of maintenance of the chiller. Therefore, it makes it easy for the user to set a maintenance plan.

Figure 10:
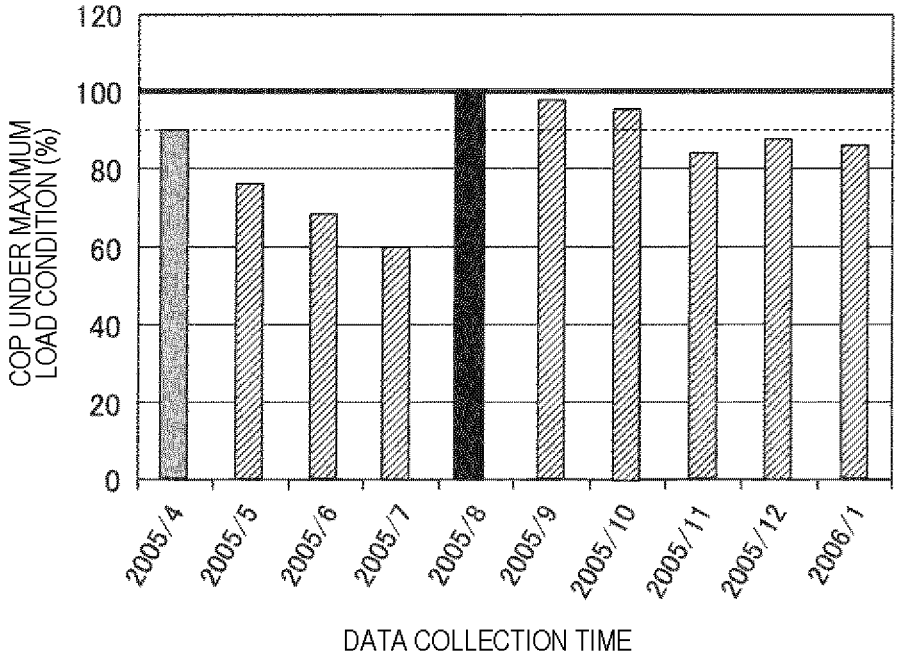
FIG. 10 is a graph illustrating an example of a screen output as a result of the performance evaluation of the first embodiment.

FIG. 10 illustrates an example of the evaluation result displayed on the operation data monitor 3. The horizontal axis represents the data collection timing, and the vertical axis represents the COP under the maximum load condition (the cooling water inlet is at maximum temperature and the load rate is 100%), which is a representative value of the performance. In other words, it is a time series of the COP. The COP is expressed as a percentage of the reference value. This is also called "COP ratio". In this drawing, the COP under the maximum load condition is illustrated, but the COP under any operating condition (load condition) may be used. The gray bars are the reference values set in April 2005, and the black bars are the new reference values updated in August 2005. Other bars hatched with diagonal lines represent data collected at each time.

In this drawing, the description is made on the assumption that the maintenance is required and the evaluation is performed at a COP reduction rate of 25%. The chiller 2 began collecting data in April 2005. The performance was reduced by 25% or more in July 2005 with respect to the COP compared to the reference value as of April 2005. Therefore, the maintenance was performed as of August 2005. Subsequently, when measurement was performed in August 2005, the performance was superior to the reference value. Therefore, the performance was newly evaluated using the performance in August 2005 as the reference value. From September 2005 to January 2006, the COP declined moderately, indicating that no maintenance was required at this point.

In this drawing, data for each month is illustrated, but the invention is not limited to this. For example, data for each week may be acquired, and the necessity of maintenance may be determined using the data.

As a result, small changes in individual chillers can be accurately and frequently acquired, and deterioration can be determined at an early stage.

In addition, by illustrating the previous reference value together with the updated new reference value, it is easy for users to understand the effect of improving the performance of the chiller by the maintenance, and to plan the time for the next maintenance in advance.

In addition, based on the maximum value of the air conditioning load rate at the time when the air conditioning load rate becomes high (in the case of a chiller, generally in the midsummer), in the case of a chiller, the air conditioning load rate becomes generally 50% or less (half of less) with respect to the maximum value during the periods of spring, fall, and winter. In such periods, performance evaluation using the operation data collected at that time makes it possible to perform maintenance that involves shutting down the air conditioner without significantly impairing the comfort inside the building, as necessary. More preferably, the above ratio is 30% or less.

According to the performance evaluation device of this embodiment, the following effects are obtained.

First, by creating individual characteristic surfaces for air conditioners with different initial system performances even for the same model depending on the installation location and operating conditions, the system performance without deterioration is obtained in the entire expected operating range. Therefore, the degree of deterioration can be diagnosed using the system performance in the condition without deterioration under the same operating conditions as the evaluation target data as the reference value, and the deterioration of the system performance of the air conditioner can be detected in a short period of time. In other words, performance deterioration of the air conditioner can be detected more quickly.

With the function of updating the reference value, even if the reference data created at the time of starting the data collection contains deterioration, ultimately, a value without deterioration to which a dimensional error of each device, a different in the installation state, a difference in the operating condition and the operating situation are reflected can be set as a reference value. Therefore, a more accurate chiller deterioration diagnosis technique can be provided.

In addition, despite the fact that deterioration detection is performed with high accuracy, the number of measurement sensors is small, and the introduction cost can be reduced.

The performance diagnosis can be performed in accordance with the operating conditions of the evaluation target data, regardless of the operating conditions of the air conditioner. For this reason, the performance deterioration can be detected at a time when the cooling load is low, and as a result, it is possible to perform the maintenance involving stopping the operation of the air conditioner without impairing the comfort in the building.

Second Embodiment

The performance diagnosis device for this embodiment has the same configuration as the device described in the first embodiment, but is applied to a diagnostic method that detects an abnormality when the deviation is large, with a change amount of evaluation data with respect to normal data as a deviation.

Specifically, the performance diagnosis device of this embodiment is different from the first embodiment in the content of the model database stored in the sub memory device 11 illustrated in the block diagram of FIG. 1, the data creation method in the reference data creation unit 10A, the evaluation method of the system performance evaluation unit 10C, and the reference data update unit 10D.

First, in the reference data creation unit 10A of this embodiment, for example, data for the first one year in the operation data stored in the operation data collection unit 4 is assumed to be data containing no deterioration, and all the data is set as the reference data (hereinafter referred to as "learning data"). The learning data includes not only raw data of the sensors collected by the operation data collection unit 4 but also calculated values using the raw data.

Next, a method for evaluating system performance according to this embodiment will be described.

Figure 11:
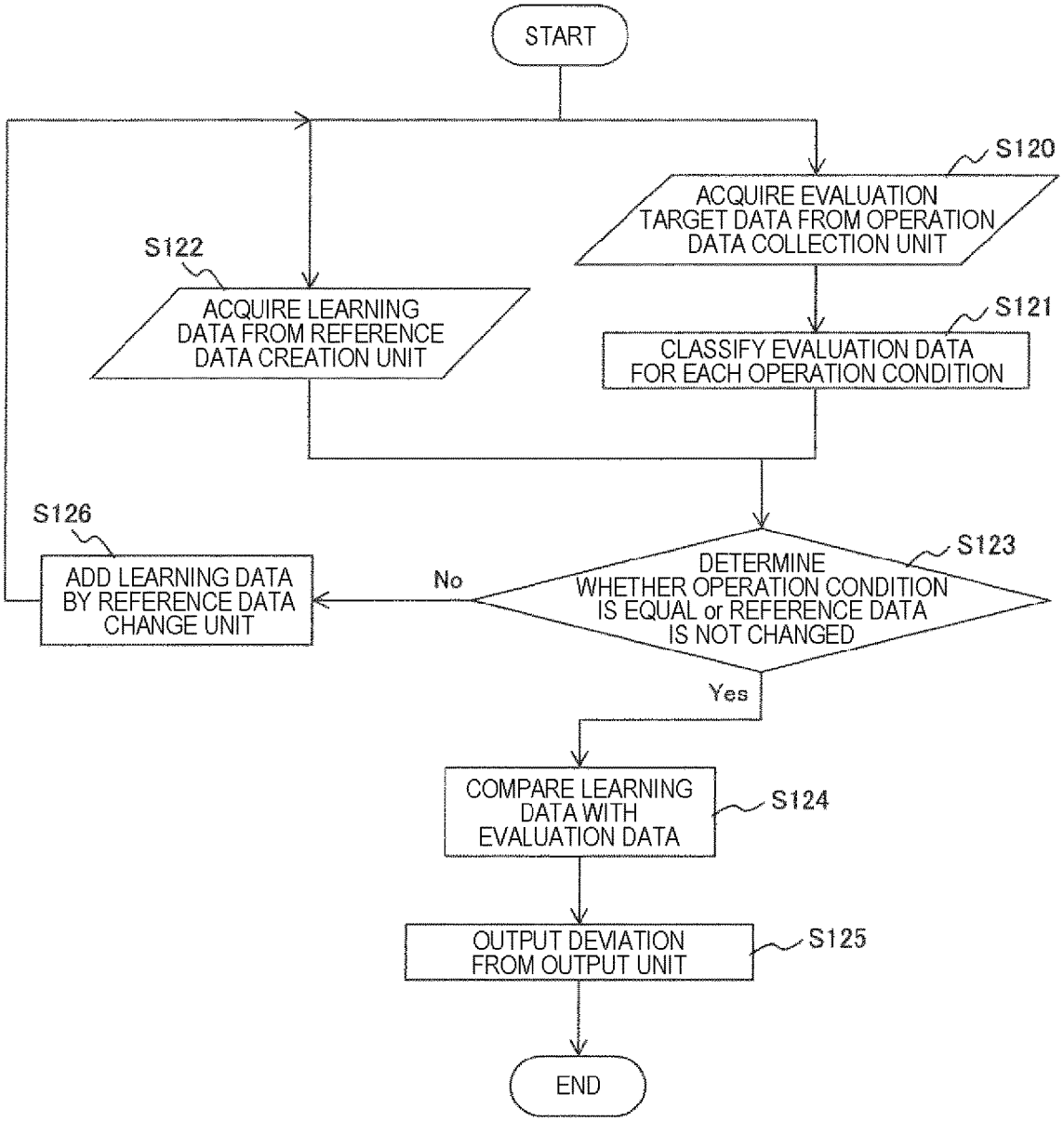
FIG. 11 is a flowchart illustrating processing steps in a system performance evaluation unit according to a second embodiment.

FIG. 11 is a flowchart illustrating processing steps in the system performance evaluation unit 10C of this embodiment.

First, in S120, the evaluation target data is acquired from the operation data collection unit 4. Next, in S121, the evaluation target data is classified for each operating condition. This operating condition is the cooling water inlet temperature in this embodiment. The operating conditions need only to be non-dependent on the performance of the chiller, and may be, for example, a load rate.

Meanwhile, in S122, learning data is acquired from the reference data creation unit 10A. Subsequently, the process proceeds to S123, where the operating conditions of the learning data and the evaluation data are compared. If the operating conditions are the same, the process proceeds to S124, where the deviation of the evaluation target data with respect to the learning data is calculated for each of the retained pieces of data, and the total sum is used as the evaluation result. Finally, the evaluation result is output from the output unit 10E of the main memory device 10 and displayed on the operation data monitor 3 via the output device 15 in S125.

On the other hand, if the operating conditions are different, the process proceeds to S126, where the reference data update unit 10D adds the learning data. This corresponds to S206 of the flowchart (FIG. 9) illustrating the processing steps of the reference data update unit according to the first embodiment.

Figure 12:
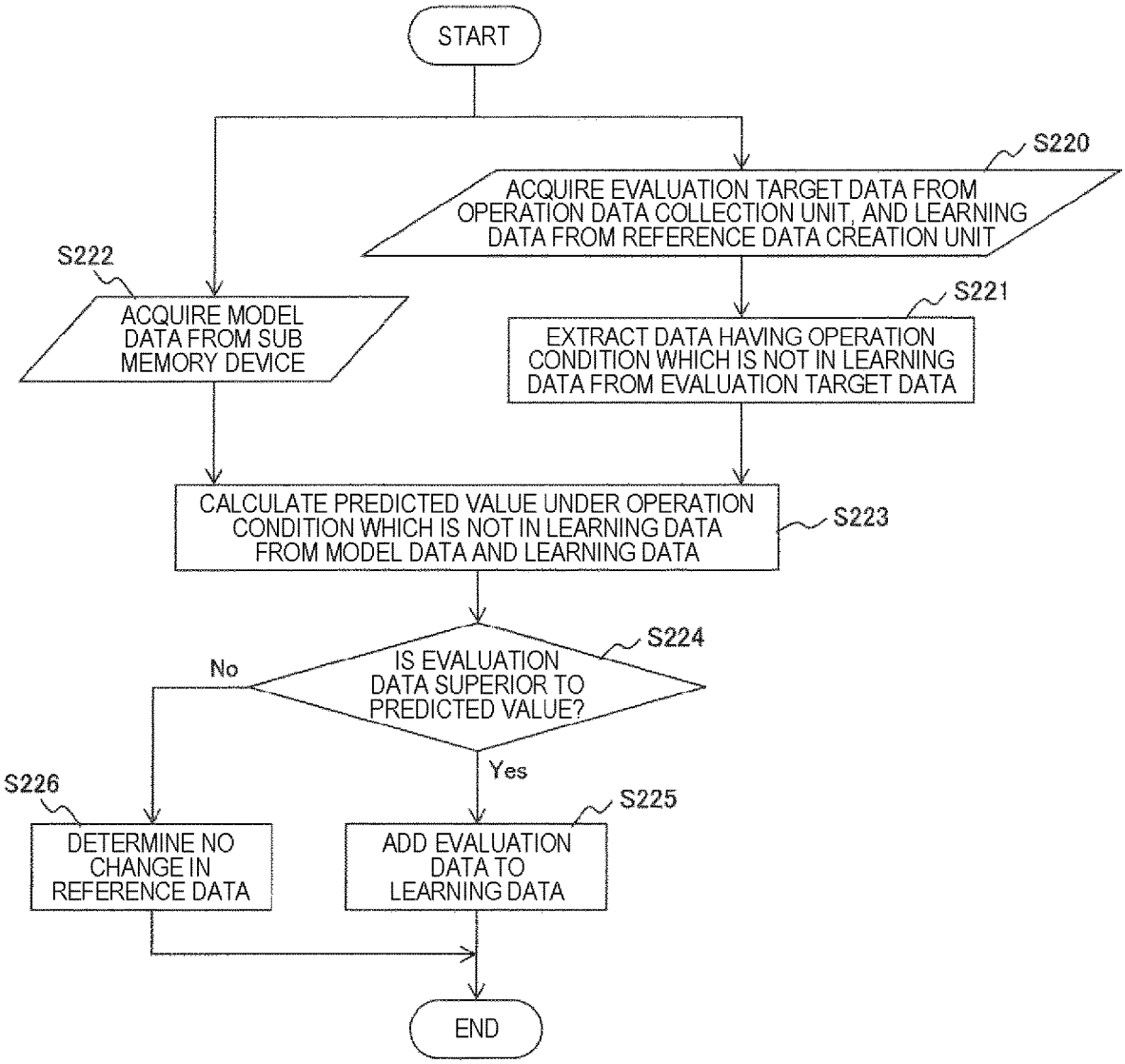
FIG. 12 is a flowchart illustrating processing steps in a reference data update unit according to the second embodiment.

FIG. 12 is a flowchart illustrating processing steps in the reference data update unit 10D of this embodiment.

First, in S220, evaluation target data is acquired from the operation data collection unit 4, and learning data is acquired from the reference data creation unit 10A. Next, in S221, data that does not match the operating conditions of the learning data is extracted from the evaluation target data.

At the same time, in S222, a model database is acquired from the sub memory device 11. In the model database of this embodiment, a relational expression representing the relationship between the load rate and the COP is stored for each cooling water inlet temperature condition. In S223, based on these relational expressions and the learning data, a predicted value of the COP under operating conditions not included in the learning data in the evaluation target data is calculated. Here, the predicted value may be calculated by an interpolation method or an extrapolation method using the above relational expression or the like. Thus, under any operating condition, if there is a predicted value such as the COP above the individual characteristic surface as illustrated in FIG. 6, it can be determined that the evaluation data is excellent.

Subsequently, in S224, the predicted value is compared with the evaluation data. If the evaluation data is superior, the process proceeds to S225, where the evaluation data is added to the learning data.

On the other hand, if the learning data is superior to the evaluation data in S224, the process proceeds to S226, and it is determined that the learning data is not changed.

The evaluation data processed by the reference data update unit 10D is returned to the system performance evaluation unit 10C again, regardless of whether the learning data is added, and is provided for processing.

According to the performance evaluation device of this embodiment, the following effects are obtained.

First, the deviation of the evaluation target data with respect to the learning data is calculated for all sensor data and calculated values, and the total sum is used as the evaluation target, so that the change in performance can be evaluated in multiple aspects compared to a detection method in which one of the changes in performance such as the COP is monitored. Therefore, it is possible to detect an abnormality of the chiller at an earlier stage.

In addition, with a configuration that updates the learning data, it is possible to prevent erroneous detection due to mere differences in operating conditions, and learning data is accumulated as the operating time elapses, enabling more accurate sign detection.

Further, performance can be easily evaluated even under operating conditions different from the maximum load condition, so that occurrence of errors due to data conversion or the like can be suppressed.

REFERENCE SIGNS LIST

1 performance evaluation device
2 chiller
3 operation data monitor

10 main memory device
10A reference data creation unit
10B evaluation data collection unit
10C system performance evaluation unit
10D reference data update unit
10E output unit
11 sub memory device
12 interface
13 CPU
14 input device
15 output device
20 electric motor
21 turbo compressor
22 condenser
22*a* cooling water flow meter
22*b* cooling water inlet temperature sensor
22*c* cooling water outlet temperature sensor
23 expansion mechanism
24 evaporator
24*a* chilled water flow meter
24*b* chilled water inlet temperature sensor
24*c* chilled water outlet temperature sensor
25, 28 water circulation pump
26 cooling tower
26*a* cooling tower fan
27 space to be cooled

The invention claimed is:

1. A performance diagnosis device for an air conditioner that diagnoses a performance of the air conditioner, comprising:

a processor;

a memory coupled to the processor, the memory storing instructions that when executed by the processor, configure the processor to:

collect and record operation data of the air conditioner from a plurality of sensors of the air conditioner, the plurality of sensors including a chilled water inlet temperature sensor and a chilled water outlet temperature sensor, maintain a model database including a data group indicating a performance corresponding to each operating condition of the air conditioner, create reference data that is a combination of a plurality of operating conditions and a reference value based on the operation data from a first year of operation of the air conditioner and the model database, the operating conditions including a load rate, a coefficient of performance, and a cooling water inlet temperature of the air conditioner, the load rate being a ratio of a difference between a sensor value of the chilled water inlet temperature sensor and a sensor value of the chilled water outlet temperature sensor of the operation data from the first year of operation of the air conditioner to a difference between a value of the chilled water inlet temperature and a value of the chilled water outlet temperature that is a maximum in the model database, compare the reference data and evaluation data that is the operation data to be evaluated, and evaluate the performance of the air conditioner, compare the reference data and the evaluation data when the operating conditions match with each other, and update the reference data in a predetermined case, wherein a maintenance for the air conditioner is conducted based on a result of the evaluating the performance of the air conditioner.

2. The performance diagnosis device for an air conditioner according to claim 1, wherein the reference data are corrected for the model database so as to correspond to the operation data.

3. The performance diagnosis device for an air conditioner according to claim 1, wherein the processor is configured to, when the operating condition of the evaluation data does not match the operating condition composing the reference data, update the reference data by adding the evaluation data to the reference data.

4. The performance diagnosis device of an air conditioner according to claim 1, wherein the processor is configured to, when the operating condition of the evaluation data matches the operating condition of the reference data, compare the reference value of the reference data with a representative evaluation data datum of the evaluation data, and when it is determined that the evaluation data are improved in performance, the reference data are updated using the representative evaluation datum as a new reference value.

5. The performance diagnosis device for an air conditioner according to claim 1, wherein the processor is configured to, when the operating condition of the evaluation data does not match the operating condition of the reference data, update the reference data by adding the evaluation data to the reference data only when it is determined that a representative evaluation datum of the evaluation data is improved in performance rather than the reference value in the operating condition of the evaluation data estimated from a combination of the operating conditions composing the reference data and the reference value.

6. The performance diagnosis device for an air conditioner according to claim 1, wherein the model database is a data group covering operating conditions satisfying specifications of the air conditioner.

7. The performance diagnosis device for an air conditioner according to claim 1, further comprising a display unit, wherein the processor is configured to, display on the display unit, the reference data and the evaluation data in a comparable manner, and when the reference data are updated, the reference data before and after the update, and the evaluation data are displayed on the display unit.

8. The performance diagnosis device for an air conditioner according to claim 1, wherein the reference value is a coefficient of performance or an LTD.

9. A performance diagnosis method that diagnoses a performance of an air conditioner that includes a plurality of sensors, the plurality of sensors including a chilled water inlet temperature sensor and a chilled water outlet temperature sensor, the method comprising:

collecting and recording operation data of the air conditioner from the plurality of sensors of the air conditioner, the plurality of sensors including the chilled water inlet temperature sensor and the chilled water outlet temperature sensor;

maintaining a model database including a data group indicating a performance corresponding to each operating condition of the air conditioner;

creating reference data that is a combination of a plurality of operating conditions and a reference value based on the operation data from a first year of operation of the air conditioner and the model database, the operating conditions including a load rate, a coefficient of performance, and a cooling water inlet temperature of the air conditioner, the load rate being a ratio of a difference between a sensor value of the chilled water inlet temperature sensor and a sensor value of the chilled water outlet temperature sensor of operation data from the first year of operation of the air conditioner to a difference between a value of the chilled water inlet temperature and a value of the chilled water outlet temperature that is a maximum in the model database;

comparing the reference data and evaluation data that is the operation data to be evaluated, and evaluating the performance of the air conditioner; and comparing the reference data and the evaluation data when the operating conditions match with each other, and updating the reference data in a predetermined case, wherein a maintenance for the air conditioner is conducted based on a result of the evaluating the performance of the air conditioner.

* * * * *